United States Patent [19]

White et al.

[11] 4,054,768

[45] Oct. 18, 1977

[54] SYSTEM FOR INCREASING VISIBILITY AND MICROWAVE DISTRIBUTION WITHIN A MICROWAVE OVEN

[76] Inventors: Donald A. White; Donald J. White, both of 4701 E. Kessler View, Indianapolis, Ind. 46220

[21] Appl. No.: 712,198

[22] Filed: Aug. 6, 1976

[51] Int. Cl.[2] ..... H05B 9/06

[52] U.S. Cl. ..... 219/10.55 D; 219/10.55 F

[58] Field of Search ..... 174/35 R, 35 MS; 219/10.55 D, 10.55 F, 10.55 R; 126/211

[56] References Cited

U.S. PATENT DOCUMENTS

| | | | |
|---|---|---|---|
| 2,920,174 | 1/1960 | Haagensen | 219/10.55 D |
| 2,958,754 | 11/1960 | Hahn | 219/10.55 D |
| 3,088,453 | 5/1963 | Grahn et al. | 219/10.55 D |
| 3,177,334 | 4/1965 | Kinkle | 219/10.55 D |

*Primary Examiner*—Arthur T. Grimley
*Attorney, Agent, or Firm*—Beall & Jeffery

[57] ABSTRACT

Visibility to the interior of a microwave oven is improved through a microwave shield that can be driven with periodic motion to increase the visibility through the shield, with such driving being accomplished by an electromechanical vibrator, a manual impulse given to the shield that is spring mounted, a power take-off from a conventional motor driven microwaver mixer, a separately motor driven cam, or the like. Such periodic motion may be oscillation such as reciprocation, or rotary with constant, decreasing or increasing amplitude, which amplitude may be the distance between adjacent apertures in the shield. Such periodic movement of the shield will scatter the microwave energy striking it and improve the distribution of microwave energy within the oven, which scattering may be enhanced by a three-dimensional mechanical texture given to the interior face of the shield, a coating with crystalline or metallic particles, or the like that will randomly scatter microwave energy striking it.

15 Claims, 5 Drawing Figures

SYSTEM FOR INCREASING VISIBILITY AND MICROWAVE DISTRIBUTION WITHIN A MICROWAVE OVEN

BACKGROUND OF THE INVENTION

In microwave ovens, an enclosure that is generally impermeable to microwave energy forms a cavity within which a body is to be heated, microwave energy is introduced into the cavity, and passage of the microwave energy through the body will tend to vibrate moisture particles and thus create heat within the body. The microwave energy that enters the cavity will enter in a specific pattern and generally be reflected statically throughout the cavity in a pattern that may produce hot and cold spots within a body to be heated. To avoid such a pattern within the cavity, electronic or mechanical mixers will randomly distribute the microwave energy, but still in a somewhat predictable pattern. Various attempts have been made to control the distribution of the microwave energy, for example by motor driven fanlike mixers that will first receive the microwave energy introduced into the cavity to distribute it throughout the cavity, various complicated driven polarizing screens as for example in U.S. Pat. No. 3,189,722 to Fritz of June 15, 1965, or fixed protuberances on the cavity walls for reflecting microwave energy at different angles as for example in the U.S. Pat. No. 3,461,260 to Bremer of Aug. 12, 1969.

Once the microwave energy has achieved the right angle to enter the food, it will usually be completely absorbed and converted to heat, when the oven is used for heating food. An uneven pattern of distribution within the cavity results in certain portions of the food being overheated with other portions of the food being too cool, producing uneven baking or cooking results. It is possible that many of the microwaves will utilize only one stationary wall as a reflecting portion before entering the food, making any stationary protuberances critical on such a wall, since a static entrance of microwaves into the cavity would, upon hitting such a wall, always diffuse in the same pattern. Only by movement of such a wall or other mixer can the undesirable effect of uneven distribution be minimized by creating an increased diffusion.

As in conventional ovens, it is well known to provide an area of visibility or a window through the enclosure of the oven for viewing of the body being heated, particularly the food being cooked. However, such a window or area of visibility must be shielded with respect to microwave energy, so that it will not pass microwave energy from the cavity to the exterior of the enclosure. Such shielding usually employs a plurality of closely spaced aperatures in a metal shield, with the dimensions of the aperatures being small enough to prevent passage of the microwave energy. However, such shields with their small aperatures greatly decrease the visibility through the window and therefore it is difficult to visually determine the precise appearance of foods during preparation, such as the degree of cooking, liquid starting to boil, and the like, which can result in overcooking the food, creation of a mess from boiling within the oven, uneven cooking due to the cook's failure to reposition foods should such a need be visually indicated by uneven cooking patterns during the cooking process, and a careful user must open and close the oven door quite frequently to obtain a better visual check on the food being prepared, which would result in starting and stopping the unit frequently, which can shorten the life of the magnetron tube.

Even though it may be possible to employ a special type of glass in the door, there is always the danger of a break or crack, so that still the microwave shield is still the major consumer protection against direct leakage of the microwave through a window area, and their necessary construction will greatly decrease the visibility through the window. This decrease in visibility is due not only to the small effective open area but also due to the fact that the shield is in a separate plane spaced from the food which will represent a distraction to the eyes attempting to focus beyond the plane of the shield.

SUMMARY OF THE INVENTION

It is an object of the present invention to improve the visibility through the enclosure of a microwave oven, specifically through the microwave shield employed in a visibility area or window. This increased visibility is accomplished by moving the microwave shield with periodic motion.

Such periodic movement of the microwave shield may be vertical, horizontal, circular, or any combination of these movements and may be continuous in rotation, oscillation, reciprocation, or the like. The microwave shield as a part of the visibility area may be mounted in the door or in a fixed wall of the enclosure.

The drive for the microwave shield may be manual, electromechanical, electrical, fluid dynamic, any combination of such drives, or the like. With a microwave shield mounted in the door, the complete drive system may be mounted in the door or only partially mounted in the door with a mechanical, fluid, electrical, or the like connection between the portion of the drive that is mounted in the side and the portion of the drive that is not mounted in the door, which connection will accomodate movement of the door from its open to closed position. With conventional wave shields, the total amplitude of oscillation may be within the range of ⅛ of an inch to 1/16 of an inch. Such periodic movement of the shield will produce an effect that is similar to looking through a moving fan blade or propeller, which will effectively remove the wave shield as a strong focal plane and permit a much improved visibility through the wave shield and into the oven cavity.

It is a further object of this invention to improve the distribution of microwave energy within the cooking cavity of the oven and therefore help prevent the creation of patterns of hot and cold areas due to unequal distribution of microwaves within the cavity. This is accomplished by the microwave energy striking the wave shield and being reflected by the wave shield, which wave shield is being periodically moved to thereby more evenly distribute microwave energy. This effect of distribution as caused by the periodic movement of the wave shield may be used alone to increase the distribution of the microwave energy or be utilized in combination with other conventional types of stationary or moveable mixers. Further, such a wave shield will provide a very large surface area of a moveable reflector. For this purpose, the inside of the wave shield may be three dimensionally mechanically textured as by etching, embossment, distortions in the manufacture of the aperatures, or may be provided with a coating having a crystalline structure, particulate material, or the like that will randomly reflect microwave energy. Such reflective particles may be steel or metallic granules or the like.

Such periodic movement of the wave shield may be automatically started with introduction of microwave energy into the cavity and automatically stopped with discontinuance of microwave energy being introduced into the cavity, interlocked with closure of the door, manually stopped and started at any time, or controlled in any other manner as desired. Of course, to have the function of distributing the microwaves, such periodic movement may be accomplished during the entire time of microwave energy being introduced into the cavity. If the purpose of further increasing the distribution of microwave energy in the oven is not essential for a particular oven design, then the periodic movement of the wave shield may be accomplished only at periods when it is desired to increase the visibility through the enclosure.

BRIEF DESCRIPTION OF THE DRAWING

Further objects, features and advantages of the present invention will become more clear from the following detailed description of a preferred embodiment of the present invention, along with variations and modifications, all as shown in the accompanying drawing wherein.

DETAILED DESCRIPTION

Figure 1:
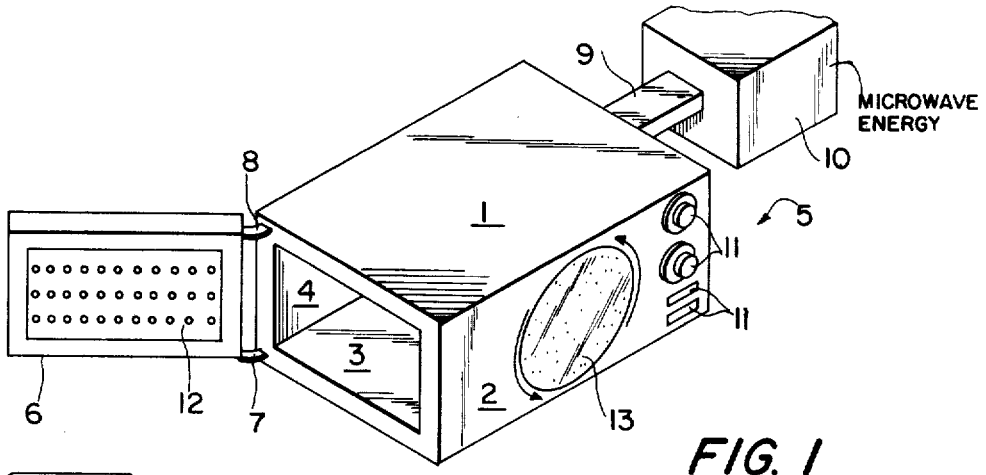
FIG. 1 is a perspective view of a microwave oven employing two embodiments of the present invention that may be used together as shown or separately as desired.

In FIG. 1, there is shown a microwave oven employing microwave shields according to the present invention. It is to be understood that the present invention may be employed with any type of microwave oven.

The microwave oven employs an enclosure made up of a top wall 1, side walls 2, 4, bottom wall 3, rear wall 5 (not shown), and front wall 6. The front wall 6 is hinged at 7, 8 to move from an illustrated open position to a closed position and thus forming a door for the oven. The complete enclosure 1–6 with the door closed will form a cavity into which microwave energy is conducted by a wave guide 9 from a source of microwave energy 10. Controls 11 mounted on the side control temperature, timing, wave shield "on-off" and speed of oscillation, for example.

It is known in microwave ovens to employ a viewing area through which a user may view the interior or cavity of the microwave oven from the exterior of the enclosure and thus monitor the progress of the heating of objects placed inside of the oven, particularly their cooking. Such a viewing area may be in the door as shown at 12 and/or in a fixed side wall as shown at 13. The entire enclosure of a microwave oven is conventionally formed of material that will prevent the passage of microwave energy and provided with sealing to prevent leakage of microwave energy. Thus, the viewing areas 12, 13 are conventionally provided with microwave shields. Microwave shields may be constructed of sheet metal with a plurality of small through apertures throughout their extent to provide for a limited viewing therethrough while at the same time preventing passage of microwave energy. Such apertures may be considered as wave guides, and according to known wave guide technology there is a cross-section at which the passage of microwaves is exponentially reduced with further reduction in the cross-sectional area, which is related to the wave length of the microwave energy.

Figure 2:
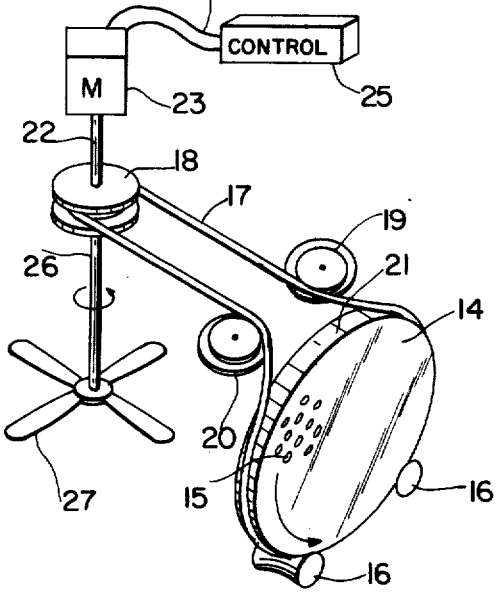
FIG. 2 is a partial perspective view showing one manner of driving the circular wave shield of FIG. 1.

The viewing area 13 in side wall 2 of FIG. 1 comprises a circular inner metalic cisc 14 with a plurality of through aperatures 15, to function as the microwave shield, and if desired, an outer pane of glass or other transparent material, which would be stationarily mounted to the side wall 2 and cover the microwave shield 14. As shown by the arrows in FIG. 1 and the arrow in FIG. 2, the microwave shield 14 is mounted for rotation, and for this purpose is supported on a plurality of roller bearings 16 secured within the side wall 2. For driving the microwave shield 14 in the direction of the arrow in FIG. 2, there is provided a belt 17 that drivingly passes around a drive pulley 18, direction changing idler pulley 19, 20, and the outer periphery 21 of the microwave shield 14, which outer periphery is constructed with a V-shaped or U-shaped channel to function as a pulley groove. The pulley 18 is driven through a shaft 22 by a motor 23, which is energized through electrical lines 24 from an electrical control 25. Such motor 23 may be used solely for the purpose of driving the shield, or as shown in FIG. 2, it may additionally drive, through shaft 26, a mixer blade 27, which mixer blade 27 is conventional in construction and used to intercept the entering microwave energy and disburse it throughout the cavity of the oven. In this manner, it is seen that a single drive motor and control may be used for both the mixer and for periodically moving, that is continuously rotating, the microwave shield 14.

With the construction of FIG. 2, it is seen that the shield will be rotated continuously whenever microwave energy is present within the cavity, because the motor will be energized to continuously rotate the mixer 27 whenever microwave energy is being introduced into the cavity. In this manner, the interior surface of the shield 14 that will reflect the microwave energy will be moving and correspondingly disburse the microwave energy in addition to the disbursement obtained with the mixer 27. This dispersion provided by the shield 14 may be increased in effect by three-dimensionally contouring the interior face of the microwave shield 14, providing it with a coating with random reflecting particles, crystals or the like, or in some other manner increasing its ability to randomly reflect the microwave energy. In view of the individual nature of different types and sizes of cavities and the manner by which microwave energy is introduced, the contouring of the interior face could be varied according to the precise pattern required for best overall distribution of the microwave energy.

Figure 3:
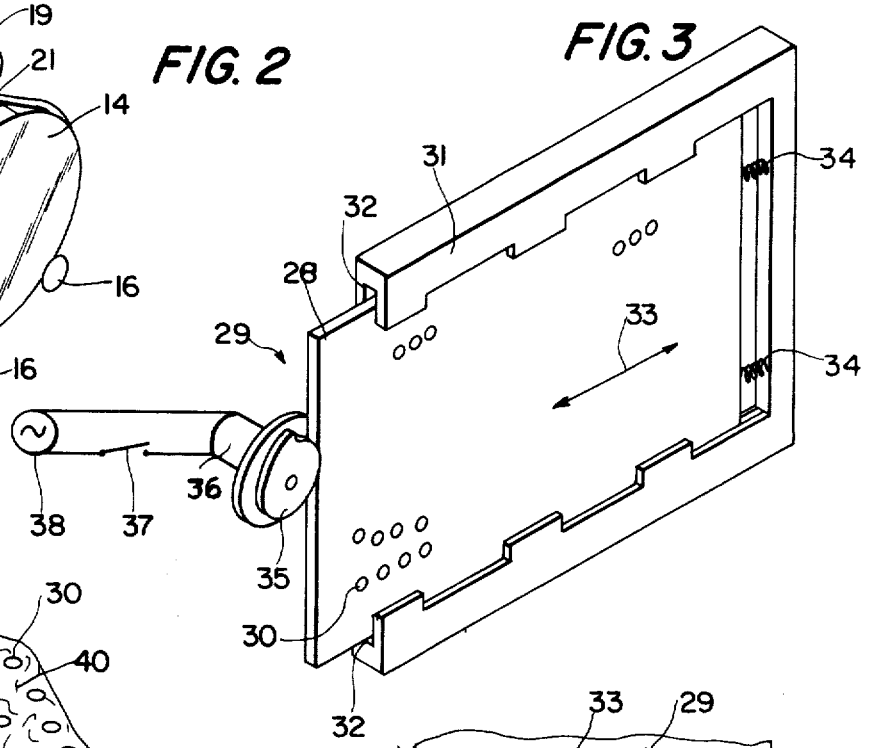
FIG. 3 is a partial perspective view showing one manner of driving the rectangular wave shield in the door of FIG. 1.

The viewing area 12 is, as shown in FIG. 1, of rectangular configuration and contained within the side wall 6 that forms the door of the enclosure. This viewing area 12 may be constructed of an outer sheet of glass or other transparent sheet material and an inner sheet of metal with a plurality of apertures to form the microwave shield. As shown in FIG. 3, this metalic sheet 28 forming the microwave shield 29 has a plurality of through apertures 30 in it for viewing through the shield but preventing the passage of new microwave energy. The shield 29 is mounted for movement with respect to the side wall 6 forming the door by means of a frame 31 that is stationary with respect to the side wall 6. The frame 31 has opposed guide channels 32 that receive therein opposite top and bottom edge portions of the sheet 28 guidingly supported for reciprocating movement in the directions of arrows 33. As shown in FIG. 3, the shield 29 is biased in the left hand direction by springs 34 and driven in the right hand direction by means of an eccentrically mounted rotatable cam 35 that engages the side edge of the metalic sheet 28 opposite from the side edge engaged by the springs 34. The cam 35 is rotatably driven by an electric motor 36 in circuit with a manual switch 37 and source of electrical energy 38. The manual switch 37 may be located on the control panel of the oven as shown in FIG. 1 so that the microwave shield 29 may be reciprocated horizontally by the cam 35 and springs 34 in the direction of arrows 33 to increase the visibility through the viewing area 12 in the side wall 6 whenever the manual switch 37 is actuated. If desired, the manual switch 37 may be replaced by an automatic switch that will automatically close whenever microwave energy is being introduced into the cavity, so that under such an operation the microwaave shield 29 would also serve the purpose of scattering microwave energy throughout the cavity due to the reciprocation of its reflecting surface.

The rectangular microwave shield shown in FIG. 3 and the rectangular viewing area 12 may be placed in the side wall 2, and similarly the circular microwave shield and viewing area 13, along with its drive, may be placed in the side wall 6 forming the door. Further, an oscillating drive may be provided for the microwave shield disc 14 rather than the continuous rotational drive.

Figure 4:
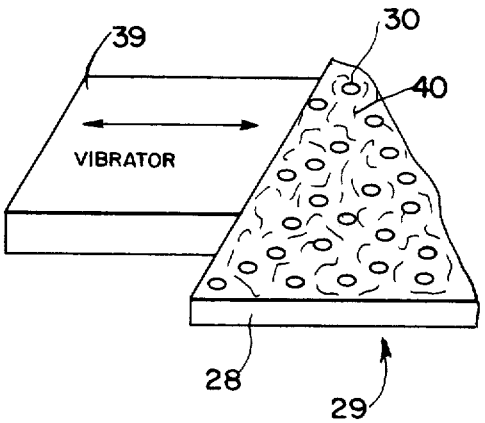
FIG. 4 is a partial perspective and somewhat schematic view of an additional manner of driving the wave shield and further shows details of the wave shield reflective surface.

As a modified drive to reciprocate the microwave shield 29 of FIG. 3, there may be employed an electromechanical vibrator 39 that would replace the cam 35, motor 36 drive of FIG. 3 and cooperate with the other structure of FIG. 3, particularly the springs 34 and switch 37. As shown in FIG. 4, the area of the microwave shield 29 that is between the apertures 30 may have a three-dimensionally textured surface 40 formed by etching, embossing, deformation of the metal when the apertures 30 are punched, for example. Alternatively, this surface area 40 may be provided with a coating having a plurality of particles, such as metalic chips, spheres or flakes randomly arranged or a plurality of crystalline structures with microwave energy reflecting surfaces at various angles. With such structure, the microwave shield 29 would be more efficient in breaking up or mixing the microwave energy reflecting from its inner surface during its periodic movement. Such a surface structure may be used for any of the microwave shields disclosed.

In FIGS. 3 and 4, the cam 35 and motor 36 or the vibrator 39 is preferably carried inside of the side wall 6 forming the door. However, such could also be carried in the side wall 4 to project from the front edge of the side wall 4 and engage the microwave shield only when the side wall 6 forming the door is in its closed position. Other types of drives are contemplated, such as pulsating fluid drives, solenoid drives, gear drives, and a manual drive as shown in FIG. 5.

Figure 5:
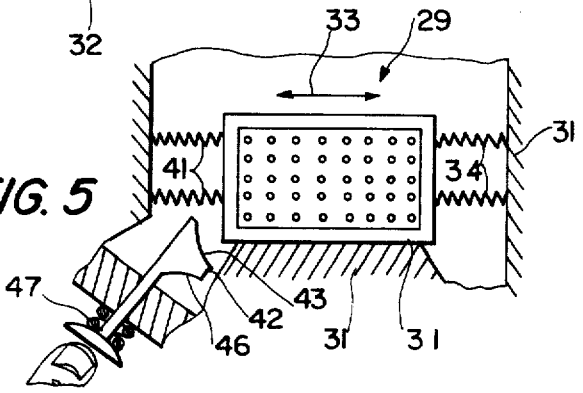
FIG. 5 schematically shows a further manner of mounting and driving the wave shield.

In FIG. 5, the microwave shield 29 is provided with additional springs 41 to engage the edge of the microwave shield 29 that is opposite from the edge engaged by the springs 34. In this manner, the microwave shield 29 is free to vibrate horizontally as shown by arrows 33 at a natural frequency as determined by the spring mass system, with damping according to friction. To start the vibration, a schematically shown cam member 42 may be moved inwardly in a direction perpendicular to the plane of the metallic sheet 28 to strike the edge of the metallic sheet 28 that is engaged by the springs 41 with a leading cam 43 to drive the microwave shield 29 to the right as shown in FIG. 5. Thereafter, with further movement of the cam 42 inwardly, the cam 42 will clear the adjacent edge to permit free vibration of the shield and thus improve viewing through the shield. With release of the cam 42, a spring 47 will move it in the opposite direction so that the trailing cam edge 46 will engage the adjacent edge of the metallic sheet 28 to permit return of the cam 42 to its original position. Thus, the drive for periodically moving the microwave shield of FIG. 5 is purely manual, that is it does not require any outside source of energy such as electricity. Further, the reciprocation of the shield in FIG. 5 would be accomplished only whenever it is desired to increase the viewing, that is it would not be conducted continuously during cooking operation, so that the microwave shield 29 would not have the mixer function previously described with respect to the microwave shields that would be continuously moved throughout the entire time that microwave energy is present in the cavity.

While a preferred embodiment of the present invention, with variations and modifications has been set forth in detail for purposes of illustration and the importance of the details, further embodiments, modifications and variations are contemplated according to the broader aspects of the present invention, all as determined by the spirit and scope of the following claims.

What is claimed:

1. A microwave oven, comprising: enclosure means for confining microwave energy and creating a cavity for receiving a body to be heated by the confined microwave energy; and means for introducing microwave energy into said cavity; said enclosure means including a door mounted for movement between a first closed position that with the remainder of said enclosure means confines said microwave energy and a second open position providing access to said cavity for the insertion and withdrawal of a body to be heated; said enclosure means being provided with a microwave shield having a plurality of transparent portions of insufficient size to pass the microwave energy from the cavity through said enclosure means to the exterior, and of sufficient size and quantity to provide visibility through said enclosure means from the outside to view the body within said cavity; and means for periodically moving said shield relative to the remainder of said enclosure means to increase the visibility through said shield to the cavity for viewing of the body to be heated.

2. The microwave oven of claim 1, wherein said shield is generally planar and said means for moving oscillates said shield generally in the plane of its extent.

3. The microwave oven of claim 1, wherein said shield is generally planar and said means for moving rotates said shield about an axis perpendicular to the plane of its extent.

4. The microwave oven of claim 1, wherein said shield includes a three-dimensionally textured surface on its interior facing said cavity for scattering microwave energy striking and being reflected by such shield.

5. The microwave oven of claim 1, wherein said means for moving said shield in a direction other than the direction of movement of said door between said open and closed positions.

6. The microwave oven of claim 1, wherein said shield is mounted within said door and said means for moving moves said shield relative to the remainder of said door.

7. The microwave oven of claim 1, wherein said means for moving includes electrical power means drivingly connected to move said shield and a manual control for selectively energizing and deenergizing said power means selectively when it is desired to view the body within said cavity.

8. The microwave oven of claim 1, wherein said means for moving includes power means for automatically moving said shield whenever microwave energy is being introduced to said cavity.

9. The microwave oven of claim 1, wherein said transparent portions are through apertures and said means for moving oscillates said shield generally in the plane perpendicular to said transparent apertures and at an amplitude at least as great as the distance between said aperatures relative to the remainder of said enclosure means.

10. The microwave oven of claim 1, wherein the inner surface of said shield facing said cavity is coated with a material having random reflection angles for microwave energy.

11. The microwave oven of claim 1, wherein said means for moving includes a rotary electric motor and drive means connected between said motor and said shield for periodically driving said shield.

12. The microwave oven of claim 1, wherein said means for moving includes an electromechanical vibrator drivingly connected to said shield for vibrating said shield relative to the remainder of said door means.

13. The microwave oven of claim 1, wherein said shield is mounted for reciprocation relative to the remainder of said enclosure means, is provided with spring means for biasing it in one direction along the line of reciprocation and power means for driving it at least in the opposite direction from said spring means along said line of reciprocation.

14. The microwave oven of claim 13, wherein said power means includes a rotary electric motor, and cam means engaging said shield and being driven by said motor for driving said shield in the direction opposite from said spring bias.

15. The microwave oven of claim 13, wherein said power means includes a second spring means for biasing said shield in the direction opposite to said first mentioned spring means, and manual means for providing an impulse to said shield at least in the direction of one of said spring means and thereafter releasing said shield for free vibration at the natural frequency as determined by said spring means and the mass of said shield.

* * * * *